US009752300B2

(12) United States Patent
Chang et al.

(10) Patent No.: US 9,752,300 B2
(45) Date of Patent: Sep. 5, 2017

(54) SYSTEM AND METHOD FOR POSITIONING IMPLEMENT OF MACHINE

(71) Applicant: Caterpillar Inc., Peoria, IL (US)

(72) Inventors: Insu Chang, Peoria, IL (US); Salim A. Jaliwala, Peoria, IL (US); Yanchai Zhang, Dunlap, IL (US); James S. Chase, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 311 days.

(21) Appl. No.: 14/697,657

(22) Filed: Apr. 28, 2015

(65) Prior Publication Data

US 2016/0319511 A1 Nov. 3, 2016

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/844* (2013.01); *E02F 3/7627* (2013.01); *E02F 3/7631* (2013.01); *E02F 9/265* (2013.01)

(58) Field of Classification Search

CPC ..... E02F 3/844; E02F 3/7627; E02F 3/7631; E02F 9/265

See application file for complete search history.

(56) References Cited

U.S. PATENT DOCUMENTS

| | | | | |
|---|---|---|---|---|
| 4,201,268 | A | 5/1980 | Frisbee | |
| 5,551,518 | A | 9/1996 | Stratton | |
| 6,112,145 | A | 8/2000 | Zachman | |
| 6,789,014 | B1 | 9/2004 | Rekow et al. | |
| 7,121,355 | B2 | 10/2006 | Lumpkins et al. | |
| 7,293,376 | B2 | 11/2007 | Glover | |
| 8,103,417 | B2 | 1/2012 | Gharsalli et al. | |
| 8,145,391 | B2 | 3/2012 | Omelchenko et al. | |
| 8,548,690 | B2 | 10/2013 | Hayashi | |
| 8,634,991 | B2 * | 1/2014 | Douglas | E02F 3/845 172/4.5 |
| 9,618,338 | B2 * | 4/2017 | Fehr | G01C 9/08 |
| 9,624,643 | B2 * | 4/2017 | Hendron | E02F 3/7627 |
| 2002/0162668 | A1 * | 11/2002 | Carlson | E02F 3/847 172/4.5 |
| 2006/0279727 | A1 * | 12/2006 | Nichols | G01C 15/00 356/139.01 |
| 2013/0261885 | A1 * | 10/2013 | Hargrave, Jr. | E02F 9/262 701/34.4 |
| 2016/0215475 | A1 * | 7/2016 | Meguriya | E02F 3/32 |

* cited by examiner

*Primary Examiner* — Jamie L McGowan

(57) ABSTRACT

A system associated with an implement of a machine is provided. The system includes a plane determination module configured to determine a track plane based on a relationship between at least two tracks of the machine. The system also includes an implement control module. The implement control module is configured to compute a location of two or more blade tip points of the implement of the machine in three dimensional space based on at least one constraint of a geometry of the implement. The implement control module is also configured to determine a blade tip point plane based on a relationship between at least two blade tip points of the implement. The implement control module is further configured to compare the blade tip point plane with the track plane and determine if the blade tip point plane is parallel to the track plane based on the comparison.

19 Claims, 6 Drawing Sheets

SYSTEM AND METHOD FOR POSITIONING IMPLEMENT OF MACHINE

TECHNICAL FIELD

The present disclosure relates to a system associated with an implement of a machine, and more particularly to a system for setting a position of the implement of the machine.

BACKGROUND

A machine, such as a track type machine, includes an implement. The implement may be used to perform a variety of work operations. In one example, the implement may perform a ground leveling operation. For the ground leveling operation, a position of the implement may have to be adjusted as per operational requirements. The implement is generally adjustable about at least one axis of the machine. For example, hydraulic cylinders associated with the implement may be actuated to change any one of a pitch angle, a yaw angle, and/or a tilt angle associated with the implement.

The pitch angle and the yaw angle are controlled by an operator of the machine. However, the operator may sometimes find it cumbersome to change the tilt angle since a ground facing edge of the implement may not be visible to the operator seated within a cab of the machine. Thus, controlling the tilt angle may depend on operator's experience and is subject to variations and errors. Moreover, a poorly tilted implement may result in an uneven flattening of a work site on which the machine is operating.

U.S. Pat. No. 7,121,355, hereinafter referred to as '355 patent, describes a dozer blade control system. The disclosed system controls the position of a bulldozer blade, maintaining the blade at a constant position as the dozer travels through a worksite. The control system monitors the angle of the dozer blade with respect to the earth and when it senses that the dozer blade is tilting, it corrects the dozer blade's position by extending or retracting hydraulic cylinders that couple the dozer blade to the chassis of the crawler-tractor. The '355 patent describes the use of blade position sensors and global positioning systems to monitor the tilt angle of the bulldozer blade. However, the use of sensors may be expensive and increase an overall machine cost. Further, the control system of the '355 patent may also be prone to errors.

SUMMARY OF THE DISCLOSURE

In one aspect of the present disclosure, a system associated with an implement of a machine is provided. The system includes a plane determination module configured to determine a track plane based on a relationship between at least two tracks of the machine. The system also includes an implement control module coupled to the plane determination module. The implement control module is configured to compute a location of two or more blade tip points of the implement of the machine in three dimensional space based on at least one constraint of a geometry of the implement. The implement control module is also configured to determine a blade tip point plane based on a relationship between at least two blade tip points of the implement. The implement control module is further configured to compare the blade tip point plane with the track plane. The implement control module is configured to determine if the blade tip point plane is parallel to the track plane based on the comparison.

In another aspect of the present disclosure, a method for analyzing a position of an implement of a machine is provided. The method includes determining a track plane based on a relationship between at least two tracks of the machine. The method also includes computing a location of two or more blade tip points of the implement of the machine in three dimensional space based on at least one constraint of a geometry of the implement. The method further includes determining a blade tip point plane based on a relationship between at least two blade tip points of the implement. The method includes comparing the blade tip point plane with the track plane. The method also includes determining if the blade tip point plane is parallel to the track plane based on the comparison.

In yet another aspect of the present disclosure, a track-type machine is provided. The track type machine includes an engine. The track-type machine also includes a frame. The track-type machine further includes an implement coupled to the frame of the machine. The track-type machine includes a plane determination module configured to determine a track plane based on a relationship between at least two tracks of the machine. The machine also includes an implement control module coupled to the plane determination module. The implement control module is configured to compute a location of two or more blade tip points of the implement of the machine in three dimensional space based on at least one constraint of a geometry of the implement. The implement control module is also configured to determine a blade tip point plane based on a relationship between at least two blade tip points of the implement. The implement control module is further configured to compare the blade tip point plane with the track plane. The implement control module is configured to determine if the blade tip point plane is parallel to the track plane based on the comparison.

Other features and aspects of this disclosure will be apparent from the following description and the accompanying drawings.

DETAILED DESCRIPTION

Figure 1:
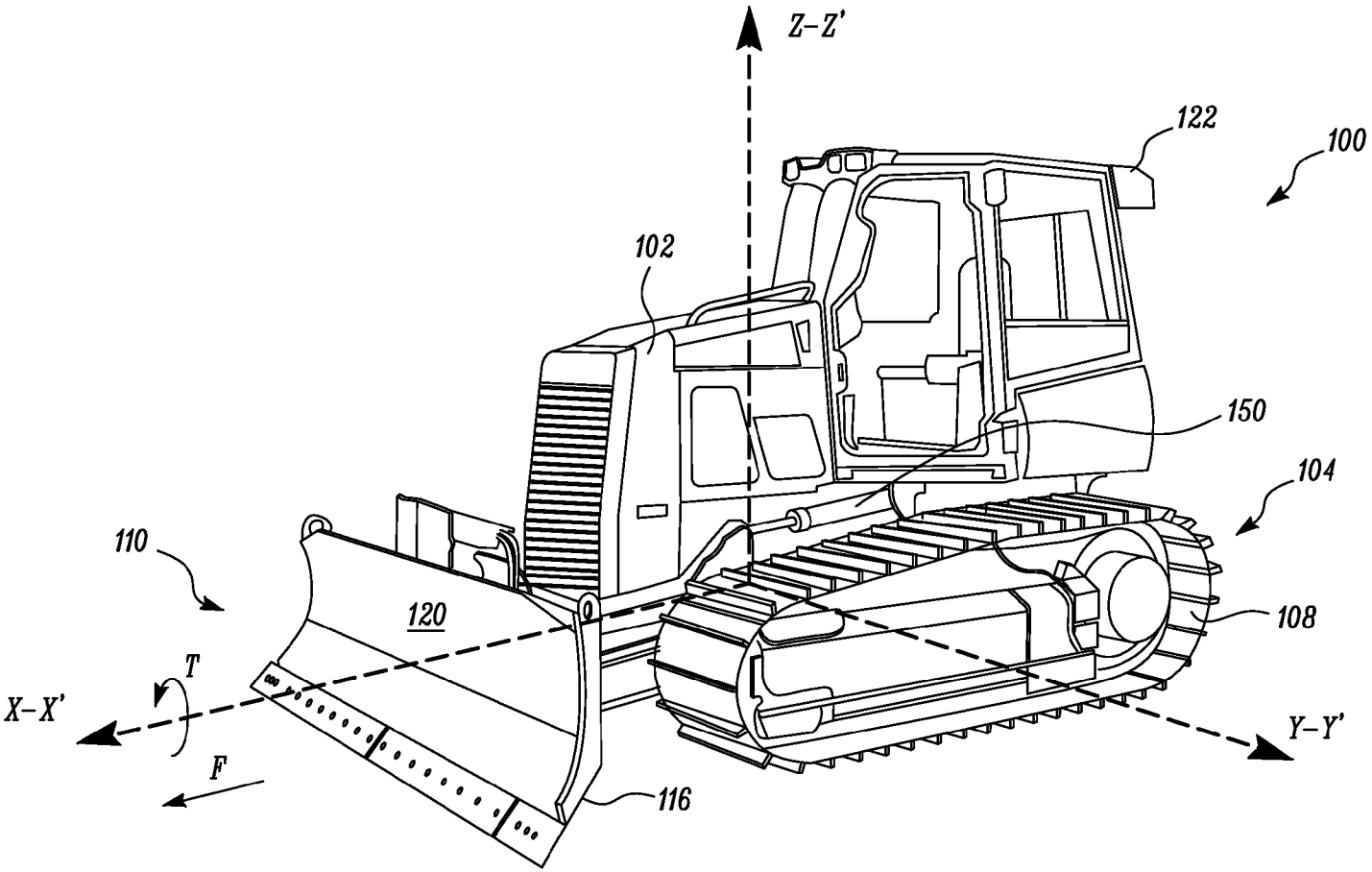
FIG. 1 is a perspective view of an exemplary machine, according to one embodiment of the present disclosure.

Wherever possible, the same reference numbers will be used throughout the drawings to refer to the same or the like parts. FIG. 1 illustrates an exemplary machine 100 according to one embodiment of the present disclosure. As illustrated, the machine 100 may embody a track type tractor. Alternatively, the machine 100 may include, but is not limited to, a track type loader or any other tracked machine associated with mining, agriculture, forestry, construction, and other industrial applications.

As illustrated in FIG. 1, the machine 100 may include a power source (not shown) provided within a hood 102, a transmission system (not shown), and a propulsion system 104. In one embodiment, the power source may include, for example, a diesel engine, a gasoline engine, a gaseous fuel powered engine such as a natural gas engine, a combination of known sources of power or any other type of known engine. The transmission system may be communicably coupled to the power source. The transmission system may include coupling elements for transmitting a drive torque from the power source to the propulsion system 104. As illustrated in FIG. 1, the propulsion system 104 may include a pair of tracks 108 having ground engaging elements configured to propel the machine 100 on ground.

Figure 2:
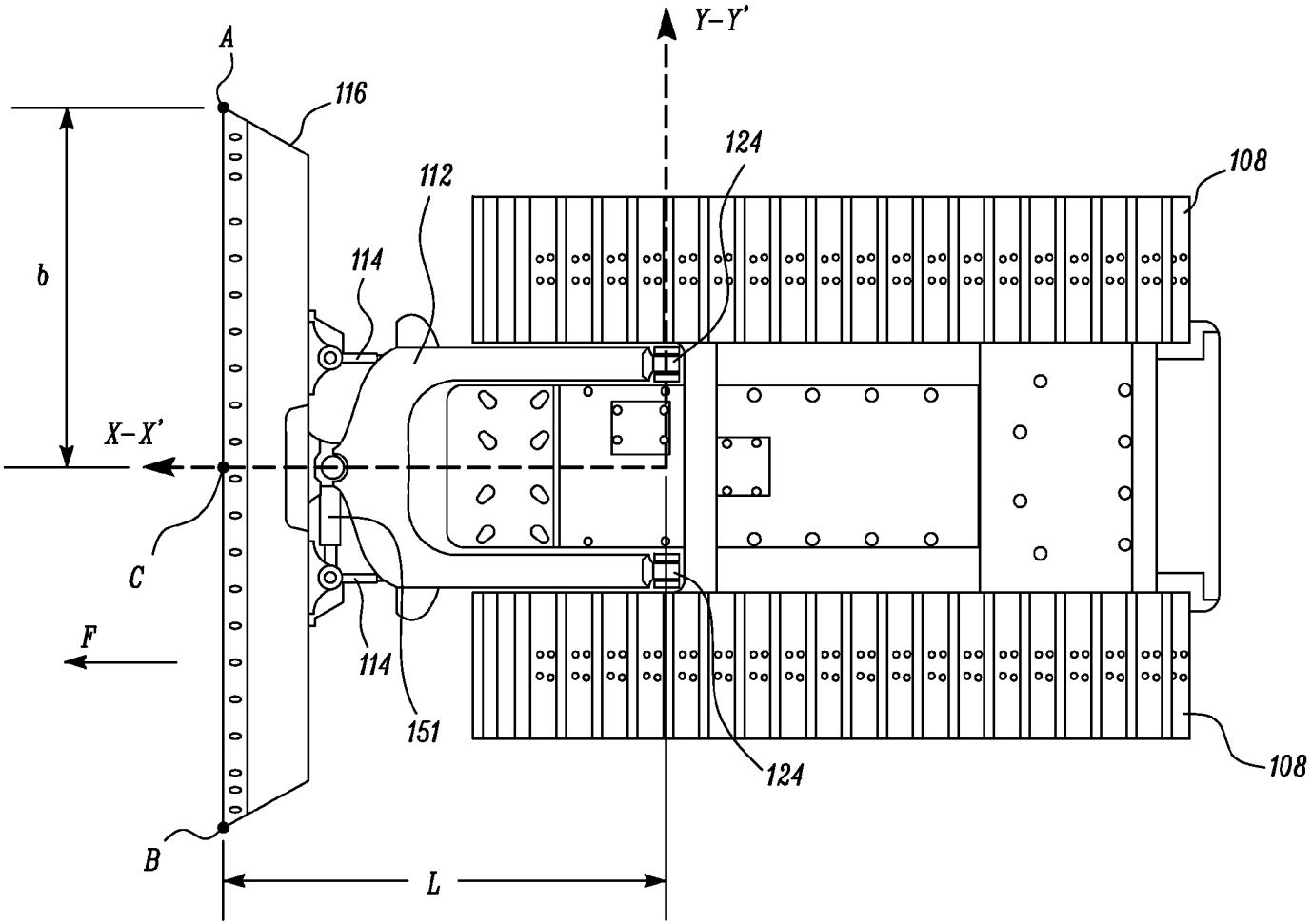
FIG. 2 is a bottom view of the machine of FIG. 1.

Referring to FIGS. 1 and 2, the machine 100 may include a load lifting assembly 110 having a C-frame 112 (see FIG. 2), one or more actuators 114, 150, 151, and an implement 116. In one example, the implement 116 is a blade 116. The actuators 114, 150, 151 may embody hydraulic and/or pneumatic actuators. In one example, the actuators 114, 150, 151 may include sensors (not shown) associated therewith. The sensors may embody position sensors. The sensors may include any known low cost position sensor such as a potentiometer or a piezo-electric transducer. The sensors may measure a position of the respective actuator 114, 150, 151. The blade 116 is configured to collect, hold and convey material and/or heavy objects on the ground. The blade 116 defines blade tip points "A", and "B", and a blade midpoint "C". The blade 116 may be configured to scrape earth materials such as, but not limited to, soil, debris, snow, or ice when the machine 100 is propelled in the forward direction "F", while a main plate 120 may be configured to collect and move the scraped earth materials. The actuators 114, 150, 151 may be configured to effectuate the movement of the blade 116 based on an operator command provided by an operator of the machine 100. The operator command may be received through various input devices present within an operator cabin 122 of the machine 100.

In order to accomplish a work operation, for example, scraping, levelling, or movement of earth materials such as, but not limited to, soil, debris, snow, or ice, the machine 100 may be propelled in the forward direction "F" along an axis X-X', as indicated in FIGS. 1 and 2. The axis X-X' is defined from a center of hinges 124 of the C-frame 112 in a direction same as that of the forward direction "F". Also, an axis Y-Y' is defined from the center of the hinges 124 of the C-frame 112, and in a direction perpendicular to the axis X-X'.

The blade 116 of the machine 100 may have to be adjusted periodically based on the operation to be performed. For example, for conducting a levelling operation, the machine 100 may have to pass through the worksite multiple times. Accordingly, after each pass the blade 116 may require adjustment based on levelling requirements. Additionally, an axis Z-Z' is defined from the center of the hinges 124 of the C-frame 112 in a vertical direction, such that the axes X-X', Y-Y', and Z-Z' are perpendicular to each other. These axes X-X', Y-Y', and Z-Z' collectively define a machine body fixed co-ordinate frame of reference which will be used later in this section. The positioning of the blade 116 may be adjusted by changing any one of a yaw angle "Ψ", a pitch angle "θ", or a tilt angle "Φ" associated with the blade 116. The term "yaw angle" referred to herein is defined as the rotation angle of the blade 116 about the axis Z-Z'. In order to change or control the yaw angle "Ψ", the actuator 114 associated with the blade 116 may be alternatively extended and/or retracted such that a rotational motion is imparted to the blade 116 about the axis Z-Z'.

The term "pitch angle" referred to herein is indicative of a lift angle or an elevation of the blade 116 of the machine 100 with respect to the axis Y-Y'. In one embodiment, the yaw angle "Ψ" and the pitch angle "θ" are user-defined parameters respectively, such that the yaw angle "Ψ" and the pitch angle "θ" may be changed or controlled based on an operator command. In another embodiment, the yaw and pitch angles "Ψ", "θ" may be changed by a controller or an electronic control module (ECM) of the machine 100. The yaw and pitch angles "Ψ", "θ" may be changed based on the operation to be performed by the machine 100. Further, based on the type of operation being performed, the respective yaw and pitch angles "Ψ", "θ" may be retrieved from any data source associated with the machine 100.

Further, the term "tilt angle" referred to herein is defined as a rolling or tilting motion "T" of the blade 116 with respect to the axis X-X'. The actuator 151 may be actuated in order to bring about the tilting motion "T" in the blade 116 about the axis X-X'.

The present disclosure describes a system 300 associated with the machine 100 configured to automatically determine the position of the blade 116 of the machine 100. The system 300 may additionally set or adjust the position of the blade 116 in three dimensional space based on the determination. In one embodiment, the system 300 may automatically adjust the tilt angle "Φ" of the blade 116 in three dimensional space for setting the position of the blade 116.

Figure 3:
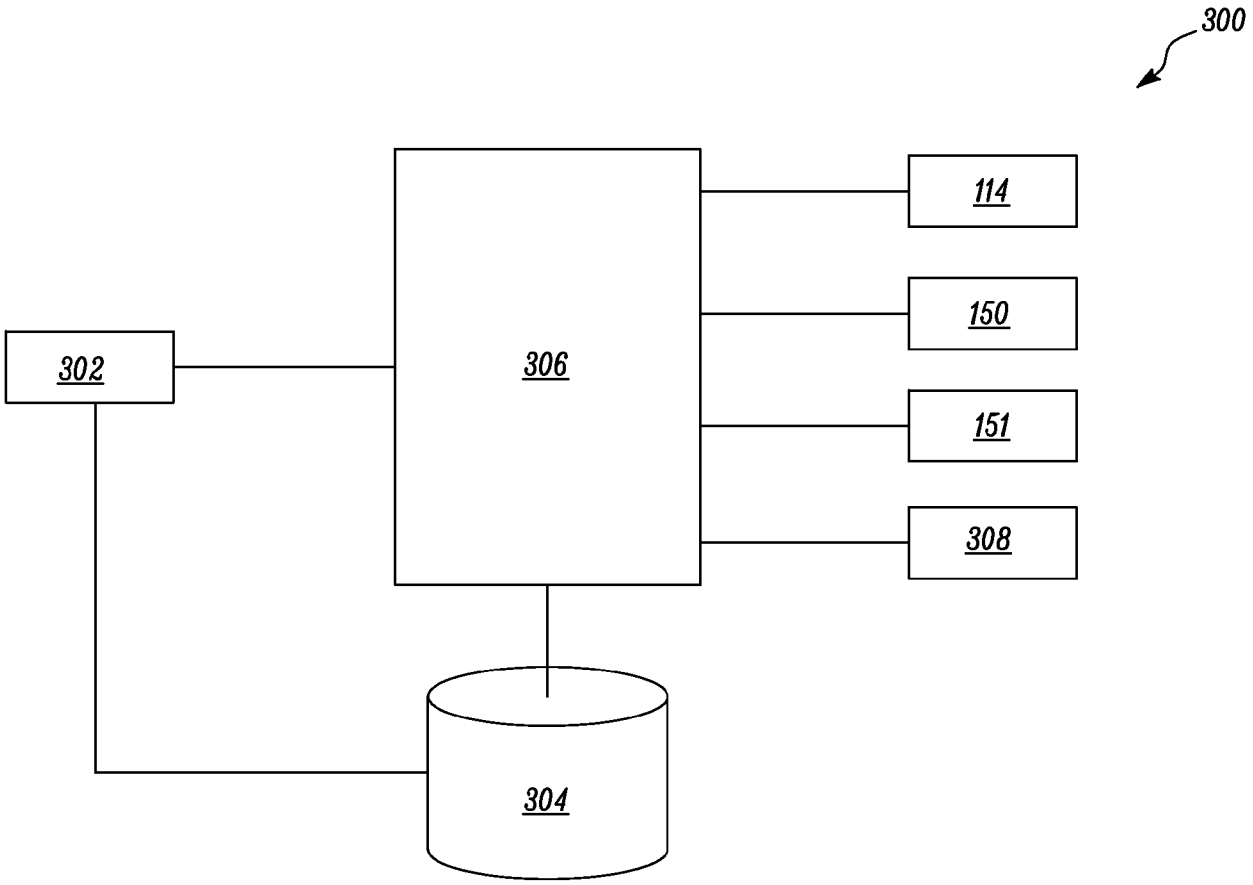
FIG. 3 is a block diagram of a system associated with an implement of the machine, according to one embodiment of the present disclosure.
Figure 4:
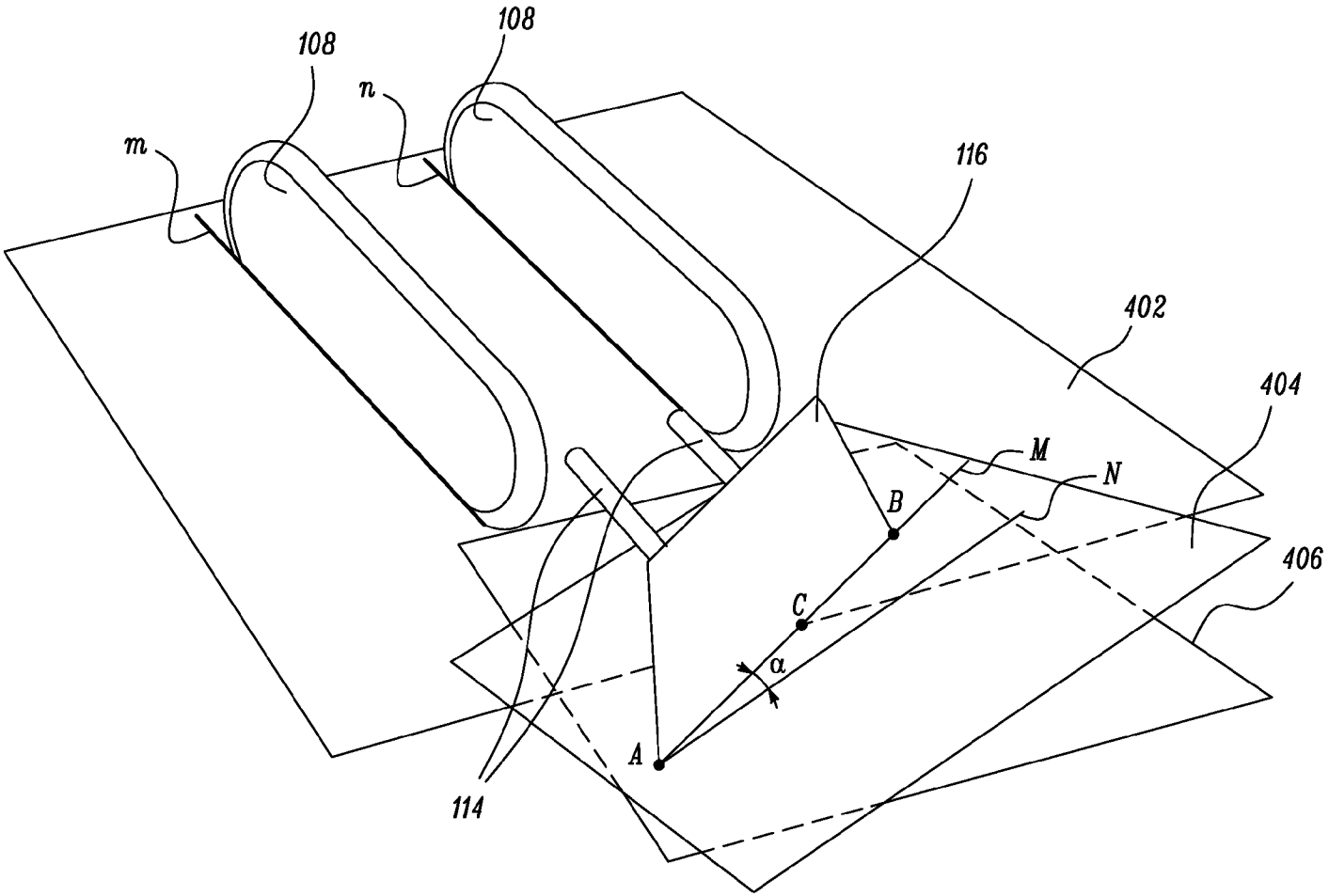
FIGS. 4 and 5 are schematic views showing different stages of operation of the system associated with the implement of the machine, according to one embodiment of the present disclosure.
Figure 5:
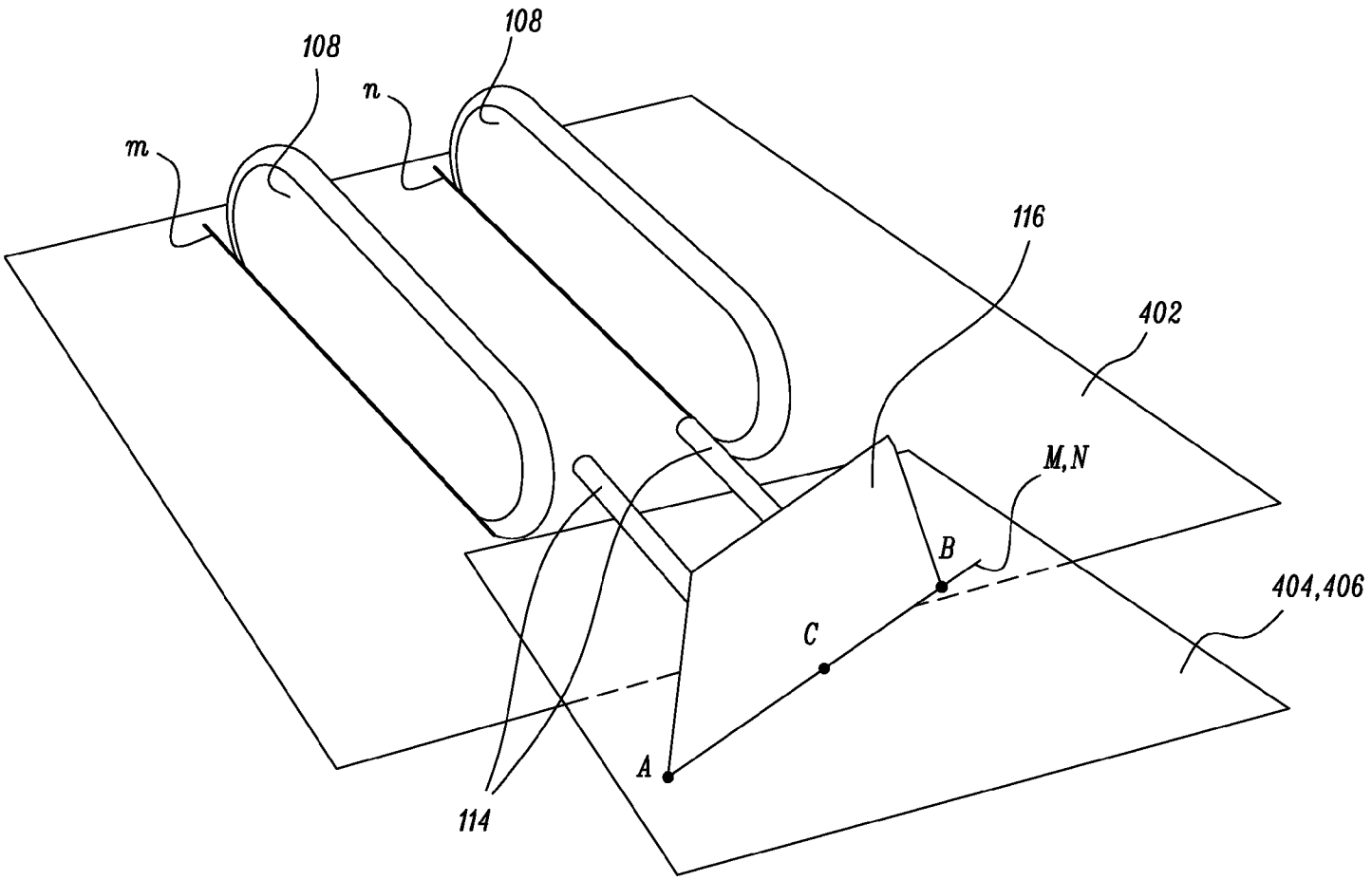

Referring to FIGS. 3, 4, and 5, the system 300 includes a plane determination module 302 (see FIG. 3). The plane determination module 302 is configured to determine a track plane 402 based on a relationship between the tracks 108 of the machine 100 (see FIGS. 4 and 5). The track plane 402 is defined as the plane containing the tracks 108 having lines "m", "n" of the machine 100. The track plane 402 may be retrieved from a terrain map of the worksite on which the machine 100 is operating. The terrain map may be stored in a database 304 associated with the system 300 and retrieved therefrom by the plane determination module 302. The terrain map may be updated on a real time basis.

Referring to FIG. 3, the system 300 includes an implement control module 306. The implement control module 306 is communicably coupled to the plane determination module 302. The implement control module 306 is configured to compute a location of the blade tip points "A", "B" of the blade 116 based on a constraint of a geometry of the blade 116. The blade tip points "A", "B" are located at the two edge points of a bottom edge (coinciding with a line "M") of the blade 116 expressed in the machine body fixed co-ordinate frame (see FIGS. 4 and 5). The blade mid point "C" is positioned at a mid point of the line "M" containing the two blade tip points "A", "B" in the machine body fixed co-ordinate frame (see FIGS. 2, 4, 5). The constraint is that an elevation of the blade tip points "A", "B" and an elevation of the blade midpoint "C" are same with respect to the machine body fixed co-ordinate frame.

The positioning of the blade tip points "A", "B" and the blade mid point "C" with respect to the machine body fixed co-ordinate frame changes when the yaw angle "Ψ" is changed. The implement control module 306 is configured to compute the position of the blade tip points "A", "B" and the blade mid point "C" when the operator changes the yaw angle "Ψ". The position of the blade tip points "A", "B" and the blade mid point "C" is based on a distance "L" (see FIG. 2). The distance "L" is the distance between the blade mid point "C" from the Y-Y' axis. The position of the blade tip points "A", "B" and the blade mid point "C" is also based on a distance "b" (see FIG. 2) between the blade mid point "C" and the blade tip point "A" or the blade tip point "B". Further, the position of the blade tip points "A", "B" and the blade midpoint "C" is a function of the yaw angle "Ψ". The implement control module 306 may compute the position of the blade tip points "A", "B" and the blade midpoint "C" after change in the yaw angle "Ψ" made by the operator of the machine 100. The position of the blade tip points "A", "B" and the blade midpoint "C" may be computed using trigonometric equations based on parameters such as, distance "L", distance "b", and the yaw angle "Ψ" in relation to the machine body fixed co-ordinate frame. In another example, the position of the blade tip points "A", "B" and the blade midpoint "C" may be additionally provided by the sensors associated with the actuator 114, 150, 151 when the yaw angle "Ψ" and/or the pitch angle "θ" is changed. Further, the sensors may send a signal corresponding to the position of the blade tip points "A", "B" and the blade midpoint "C" to the implement control module 306.

Additionally, when the operator changes the pitch angle "θ", the positioning of the blade tip points "A", "B" and the blade mid point "C" also changes. Accordingly, the positioning of the blade tip points "A", "B" and the blade midpoint "C" is a function of the distance "L", the distance "b", the yaw angle "Ψ", and the pitch angle "θ". The implement control module 306 may compute the position of the blade tip points "A", "B" and the blade midpoint "C" based on trigonometric equations using parameters such as, distance "L", distance "b", yaw angle "Ψ", and pitch angle "θ" in relation to the machine body fixed co-ordinate frame.

Referring to FIGS. 4 and 5, the implement control module 306 determines a blade tip point plane 404 based on a relationship between the blade tip points "A", "B" and the blade mid point "C". The blade tip point plane 404 is determined such that the blade tip points "A", "B" and the blade mid point "C" are contained within the blade tip point plane 404.

Further, the implement control module 306 compares the blade tip point plane 404 with the track plane 402 to determine if the blade tip points "A", "B" and the mid point "C" lie in a plane 406 (see FIG. 4) parallel to the track plane 402. Accordingly, based on the comparison, if the blade tip point plane 404 is parallel to the track plane 402, the implement control module 306 determines that no adjustment or change in the tilt angle "Φ" of the blade 116 is required to be done by the implement control module 306. Alternatively, if the blade tip point plane 404 is not parallel to the track plane 402, the implement control module 306 determines that the position of the blade 116 needs to be set or adjusted by the implement control module 306. More particularly, in such a scenario, the implement control module 306 adjusts the tilt angle "Φ" of the blade 116.

FIG. 4 illustrates an exemplary scenario in which the blade tip point plane 404 is not parallel to the track plane 402. A line "M" determined by the implement control module 306 lies in the blade tip point plane 404 and contains the blade tip points "A", "B" and the blade mid point "C". In one embodiment, the implement control module 306 may determine the plane 406 parallel to the track plane 402 such that the plane 406 also contains one of the blade tip points "A" or "B" that is in contact with the ground. In this case, the blade tip point "A" is in contact with the ground. Additionally, the implement control module 306 may determine a line "N" contained in the plane 406 and passing through the blade tip point "A".

Accordingly, the implement control module 306 may determine an angle "α" by which the tilt angle "Φ" of the blade 116 needs to be changed in order for the lines "M" and "N" to coincide. In one embodiment, the implement control module 306 is coupled to the actuators 151 associated with the blade 116 (see FIG. 3). Accordingly, the implement control module 306 may adjust the tilt angle "Φ" by the angle "α" for setting the position of the blade 116 in three dimensional space. The implement control module 306 may send a signal to the actuator 151 in order to adjust the tilt angle "Φ". FIG. 5 illustrates the position of the blade 116 wherein the blade tip point plane 404 and the track plane 402 are parallel to each other after the adjustment.

In another embodiment, the implement control module 306 may notify the operator seated within the operator cabin 122 regarding the angle "α" by which the tilt angle "Φ" needs to be adjusted or is adjusted via an output module 308 (see FIG. 3). The output module 308 is communicably coupled to the implement control module 306. In one example, via the output module 308, the implement control module 306 may notify the operator of the angle "α" by which the tilt angle "Φ" needs to be adjusted so that the operator may then take the necessary action.

In one embodiment, the output module 308 may be present on the machine 100. For example, the output module 308 may be present in the operator cabin 122 of the machine 100, and may be viewable on an operator interface. The output module 308 may embody a visual output or an audio output. In one example, wherein the output module 308 is embodied as a visual output, the output module 308 may include any one of a digital display device, an LCD device, an LED device, a CRT monitor, a touchscreen device, or any other display device known in the art. In one example, the output module 308 may notify the operator through a text message. It should be noted that the output module 308 may include any other means other than those listed above.

The location of the database 304 may vary based on the application. The data stored within the database 304 may be retrieved from any external source(s) and/or updated on a real time basis. The database 304 may be any conventional or non-conventional database known in the art. Moreover, the database 304 may be capable of storing and/or modifying pre-stored data as per operational and design needs.

The plane determination module 302 and the implement control module 306 may embody a single microprocessor or multiple microprocessors for receiving signals from components of the system 300. Numerous commercially available microprocessors may be configured to perform the functions of the plane determination module 302 and the implement control module 306. It should be appreciated that the plane determination module 302 and the implement control module 306 may embody a machine microprocessor capable of controlling numerous machine functions. A person of ordinary skill in the art will appreciate that the plane determination module 302 and the implement control module 306 may additionally include other components and may also perform other functions not described herein.

INDUSTRIAL APPLICABILITY

The present disclosure describes the system 300 to determine and adjust the tilt angle "Φ" of the blade 116 when the yaw and pitch angles "Ψ", "θ" are changed by the operator. By analyzing the position of the blade 116 in the three dimensional space and using the constraint, the positions of the blade tip points "A", "B" and the blade mid point "C" can be computed; and the tilt angle "Φ" may be determined and adjusted if required.

The disclosure provides a cost effective system 300 and a method 600 of automatically adjusting the tilt angle "Φ", as the system 300 may make use of low cost position sensors to measure the position of the blade tip points "A", "B" and the blade midpoint "C". Further, the system 300 does not require Global Positioning Systems (GPS) receivers or Inertial Measurement Units (IMU) to determine the tilt angle "Φ". Hence, the system 300 is less prone to errors, as there are no initialization or synchronization issues. The system 300 allows an accurate determination and adjustment of the tilt angle "Φ", as the system 300 is not dependent on the operator's experience.

Figure 6:
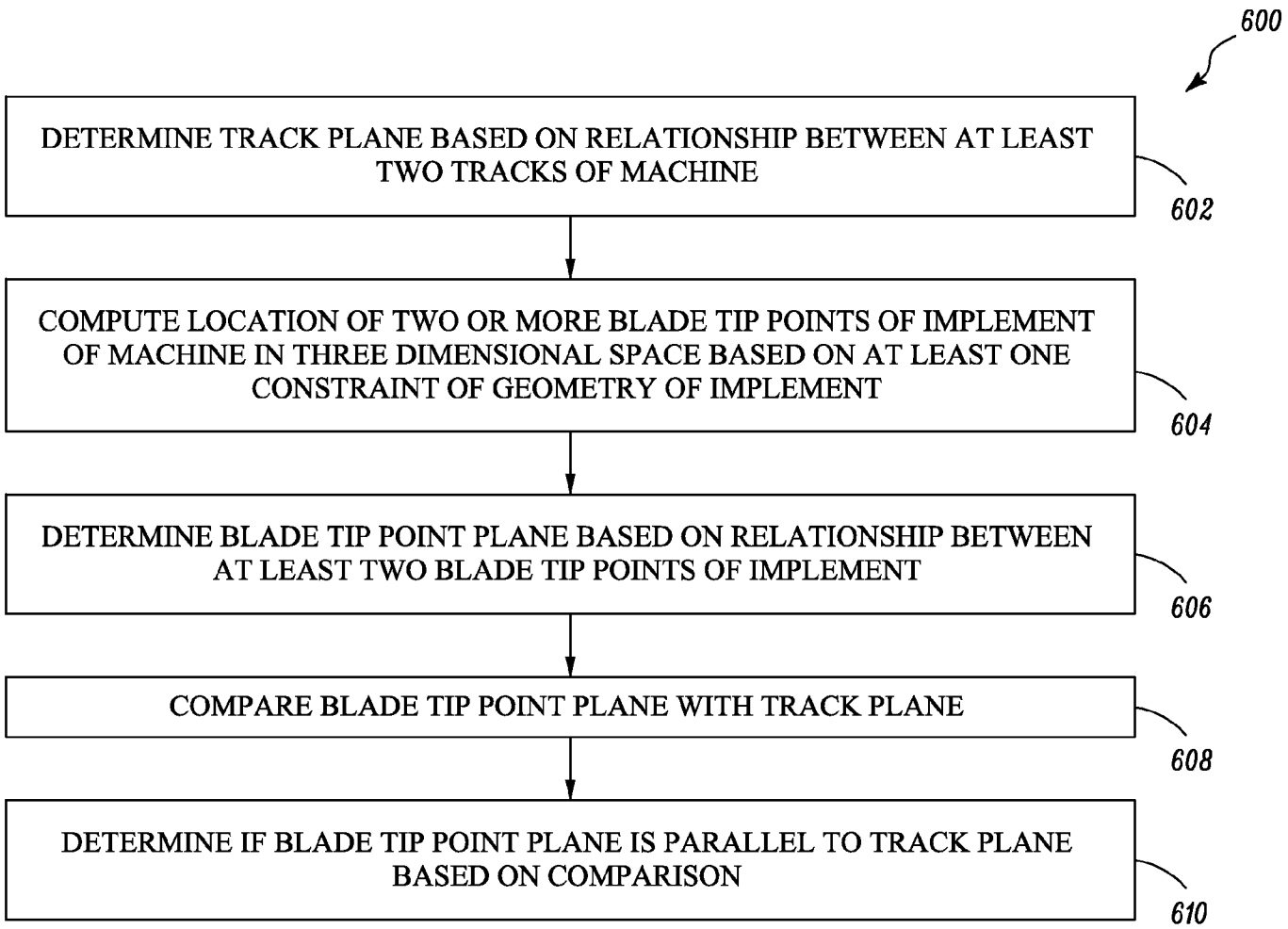
FIG. 6 is a flowchart of a method for analyzing the position of the implement of the machine.

Referring to FIG. 6, at step 602, the track plane 402 is determined based on the relationship between the two tracks 108 of the machine 100. At step 604, the location of the blade tip points "A", "B" of the machine 100 is computed in three dimensional space based on the constraint. The constraint includes matching of the elevation of the two blade tip points "A", "B" and the elevation of the blade midpoint "C".

At step 606, the blade tip point plane 404 is determined based on the relationship between the two blade tip points "A", "B". At step 608, the blade tip point plane 404 is compared with the track plane 402. At step 610, the system 300 determines whether the blade tip point plane 404 is parallel to the track plane 402 based on the comparison. Further, the system 300 is configured to set the position of the blade 116 in three dimensional space based on the determination. Also, the tilt angle "Φ" of the blade 116 is adjusted for setting the position of the blade 116. In one embodiment, the implement control module 306 is configured to notify the operator of the tilt angle "Φ" of the blade 116.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system associated with an implement of a machine, the system comprising:

a plane determination module configured to determine a track plane based on a relationship between at least two tracks of the machine; and an implement control module coupled to the plane determination module, the implement control module configured to:

compute a location of two or more blade tip points of the implement of the machine in three dimensional space based on at least one constraint of a geometry of the implement;

determine a blade tip point plane based on a relationship between at least two blade tip points of the implement;

compare the blade tip point plane with the track plane; and determine if the blade tip point plane is parallel to the track plane based on the comparison.

2. The system of claim 1, wherein the implement control module is further configured to:

set a position of the implement in three dimensional space based on the determination.

3. The system of claim 2, wherein the implement control module is configured to adjust a tilt angle of the implement for setting the position of the implement.

4. The system of claim 3, wherein the implement control module is coupled to an output module.

5. The system of claim 4, wherein the implement control module is configured to notify an operator of the tilt angle of the implement.

6. The system of claim 1, wherein the implement control module is coupled to actuators associated with the implement.

7. The system of claim 1, wherein the at least one constraint includes matching of an elevation of the two or more blade tip points of the implement and an elevation of a blade midpoint of the implement.

8. A method for analyzing a position of an implement of a machine, the method comprising:

determining a track plane based on a relationship between at least two tracks of the machine;

computing a location of two or more blade tip points of the implement of the machine in three dimensional space based on at least one constraint of a geometry of the implement;

determining a blade tip point plane based on a relationship between at least two blade tip points of the implement;

comparing the blade tip point plane with the track plane; and determining if the blade tip point plane is parallel to the track plane based on the comparison.

9. The method of claim 8 further comprising:

setting a position of the implement in three dimensional space based on the determination.

10. The method of claim 9, wherein the setting step further comprises:

adjusting a tilt angle of the implement for setting the position of the implement.

11. The method of claim 10 further comprising:

notifying an operator of the tilt angle of the implement.

12. The method of claim 8, wherein the at least one constraint includes matching of an elevation of the two or more blade tip points of the implement and an elevation of a blade midpoint of the implement.

13. A track-type machine comprising:

an engine;

a frame;

an implement coupled to the frame of the machine;

a plane determination module configured to determine a track plane based on a relationship between at least two tracks of the machine; and an implement control module coupled to the plane determination module, the implement control module configured to:

compute a location of two or more blade tip points of the implement of the machine in three dimensional space based on at least one constraint of a geometry of the implement;

determine a blade tip point plane based on a relationship between at least two blade tip points of the implement;

compare the blade tip point plane with the track plane; and determine if the blade tip point plane is parallel to the track plane based on the comparison.

14. The machine of claim 13, wherein the implement control module is further configured to:

set a position of the implement in three dimensional space based on the determination.

15. The machine of claim 14, wherein the implement control module is configured to adjust a tilt angle of the implement for setting the position of the implement.

16. The machine of claim 15, wherein the implement control module is coupled to an output module.

17. The machine of claim 16, wherein the implement control module is configured to notify an operator of the tilt angle of the implement.

18. The machine of claim 13, wherein the implement control module is coupled to actuators associated with the implement.

19. The machine of claim 13, wherein the at least one constraint includes matching of an elevation of the two or more blade tip points of the implement and an elevation of a blade midpoint of the implement.

* * * * *